US005600358A

United States Patent [19]

Baldwin et al.

[11] Patent Number: 5,600,358

[45] Date of Patent: Feb. 4, 1997

[54] INK PEN HAVING A HYDROPHOBIC BARRIER FOR CONTROLLING INK LEAKAGE

[75] Inventors: Marc A. Baldwin, Corvallis; Ella M. Duyck, Philomath; Lawrence R. Plotkin, Corvallis, all of Oreg.

[73] Assignee: Hewlett-Packard Company, Palo Alto, Calif.

[21] Appl. No.: 85,865

[22] Filed: Jun. 30, 1993

[51] Int. Cl.[6] ..... B41J 2/175; B41J 2/17

[52] U.S. Cl. ..... 347/87; 347/92

[58] Field of Search ..... 347/92, 87, 86, 347/85, 6

[56] References Cited

U.S. PATENT DOCUMENTS

| | | | |
|---|---|---|---|
| 4,149,172 | 4/1979 | Heinzl et al. . | |
| 4,207,012 | 6/1980 | Kuparinen . | |
| 4,217,058 | 8/1980 | Straszewski et al. . | |
| 4,272,773 | 6/1981 | Halasz . | |
| 4,342,042 | 7/1982 | Cruz-Uribe et al. . | |
| 4,382,707 | 5/1983 | Anderka . | |
| 4,403,229 | 9/1983 | Bartech | 347/89 |
| 4,412,232 | 10/1983 | Weber et al. . | |
| 4,422,084 | 12/1983 | Saito . | |
| 4,509,062 | 4/1985 | Low et al. . | |
| 4,620,202 | 10/1986 | Koto et al. . | |
| 4,677,447 | 6/1987 | Nielsen . | |
| 4,709,247 | 11/1987 | Piatt et al. . | |
| 4,771,295 | 9/1988 | Baker et al. . | |
| 4,777,497 | 10/1988 | Nozu et al. . | |
| 4,785,314 | 11/1988 | Terasawa et al. . | |
| 4,794,409 | 12/1988 | Cowger et al. . | |
| 4,931,812 | 6/1990 | Dunn et al. . | |
| 4,992,802 | 2/1991 | Dion et al. . | |
| 5,047,790 | 9/1991 | Cowger et al. | 347/87 |
| 5,363,130 | 11/1994 | Cowger et al. | 347/92 |
| 5,526,030 | 6/1996 | Baldwin et al. | 347/87 |

FOREIGN PATENT DOCUMENTS

| | | |
|---|---|---|
| 2063175 | 6/1981 | United Kingdom . |

*Primary Examiner*—Benjamin R. Fuller
*Assistant Examiner*—David Yockey

[57] ABSTRACT

An ink pen is provided with a hydrophobic membrane to control the leakage of ink. The ink pen has a vent, such as a bubble generator, to allow the ingress of air into the ink reservoir and thereby regulate the backpressure within the reservoir. The hydrophobic membrane which allows the flow of air but prevents the flow of ink is positioned within the vent to control leakage of ink from the ink pen through the vent.

13 Claims, 3 Drawing Sheets

INK PEN HAVING A HYDROPHOBIC BARRIER FOR CONTROLLING INK LEAKAGE

BACKGROUND OF THE INVENTION

1. Field of the Invention

The present invention relates to ink pens for ink-jet printers, and more particularly, to an apparatus for controlling ink leakage from the reservoir of an ink pen.

2. Description of Related Art

Ink-jet printers have become established as reliable and efficient printing devices. Typically, an ink-jet printer utilizes a print head which is moved relative to a printing surface. A control system activates the moving print head at the appropriate locations causing the print head to eject, or jet, ink drops onto the printing surface to form desired images and characters. Such printers typically include an ink pen which serves as a reservoir for storing ink and provides a means of supplying ink, as needed, to the print head.

There are two commonly used systems for ejecting ink from a print head. The first is a thermal bubble system and the second is a piezoelectric system. A print head using either system typically includes a plurality of orifices, each orifice having an associated chamber. In operation, ink is supplied via an inlet to the chamber. Upon activation, the ink is forced, or jetted, from the chamber through the orifice and onto the printing surface. In thermal bubble type print heads, the ink in the chamber is heated or vaporized, typically by a thin film resistor. The rapid expansion which results from vaporization of the ink forces a quantity of ink from the chamber through the orifice. In piezoelectric type print heads, a piezoelectric element creates a pressure wave within the chamber which ejects a quantity of ink through the orifice.

Although both thermal bubble and piezoelectric print heads provide a reliable and efficient means of jetting ink from an orifice, both types of print heads generally have no mechanism to prevent the free flow of ink through the orifice when the print head is not activated. If this occurs, ink may leak, or drool, uncontrollably through the print head. Typically, printers are provided with catch basins to catch and contain ink dripping from the print head. This helps to prevent the ink from damaging the printer. However, the ink may drip onto the printing surface to produce an undesirable ink spot. In addition, leaking ink may build up on the print head and impair the proper operation of the print head. In any case, a leaking ink pen will usually need to be discarded and replaced.

To alleviate these problems, many ink-jet printers supply ink from the ink pen to the print head at a slight underpressure or backpressure. As used herein a positive backpressure is used to refer to a pressure within an ink pen that is lower than the ambient pressure surrounding the print head orifice.

To be effective, the backpressure must be maintained within a desired operating range. That is, the backpressure must be large enough to prevent the unwanted free flow of ink through the orifice. At the same time, the backpressure must be small enough that the print head, when activated, can overcome the backpressure and eject the ink in a consistent and predictable manner. To meet these constraints and provide optimum operation of the ink-jet printer, a fairly constant and predictable backpressure should be maintained.

The backpressure of an ink pen is affected by changes in either the ambient pressure or the internal pressure. For example, if an ink pen is subject to an increase in altitude, such as during transport aboard an aircraft, the ambient pressure may decrease substantially. Unless the backpressure of the ink pen increases accordingly, the ambient pressure level may drop below that of the backpressure and ink will likely leak from the print head. In addition, as ink is depleted from the ink pen reservoir the backpressure within the ink pen will tend to increase. Without some mechanism to compensate for this, the backpressure may exceed the operating range of the print head and the ink pen will become inoperative. Temperature variations may cause the ink and air within the ink pen to contract or expand, thereby affecting the backpressure. All of these factors must be accounted for in order to ensure consistent trouble-free operation of the ink-jet printer.

One type of ink pen uses an expandable bladder in conjunction with a vent to maintain the proper backpressure within an ink-jet pen. The expandable bladder is situated within the reservoir and configured to expand or contract in response to depletion of ink from the reservoir, pressure changes, temperature variations, or the like. Typically, the bladder is biased with a spring or some similar mechanism which resists expansion of the bladder. This resistance helps to maintain a backpressure within the reservoir.

In conjunction with the expandable bladder, some pens incorporate a vent. The vent is typically configured to selectively allow the entry of atmospheric air into the ink reservoir when the backpressure reaches an undesirable level. The ingress of air through the vent lowers the backpressure. In this manner, the biased expandable bladder serves to create the necessary backpressure and the controlled ingress of air through the vent prevents the backpressure from exceeding the desired range.

The combination of an expandable bladder and a vent has proven to be an efficient and effective mechanism for creating and maintaining the desired backpressure within the reservoir of an ink pen. However, under extreme environmental conditions, or in the case of failure of the expandable bladder or a breach of the integrity of the ink reservoir it is sometimes possible for the backpressure in the ink reservoir to drop below the desired range. In some cases, such conditions may even create a negative backpressure (that is, a pressure within the reservoir that is higher than ambient) within the ink reservoir.

Should this occur, it is possible for ink to be forced from the reservoir. Ink forced from the reservoir will typically exit through either the print head or the vent. As discussed above, printers are typically equipped to minimize damage from ink leaking through the print head. On the other hand, ink leaking through the vent can have disastrous consequences.

In some printer configurations, no catch basin is provided to catch ink leaking from the vent. Moreover, given the usual location of the vent, ink dripping from the vent can land directly on exposed electrical circuits and electrical contacts. If this occurs, the printer may be severely damaged.

SUMMARY OF THE INVENTION

Accordingly, it is an object of the present invention to provide an ink pen having a mechanism for controlling ink leakage from an ink pen without impairing the function and operation of the ink pen.

It is a further object of the invention to provide an apparatus for controlling ink leakage from an ink pen that is easy and inexpensive to manufacture and has few complicated parts.

An ink pen in accordance with one aspect of the present invention has a reservoir for holding a supply of ink. The reservoir is provided with a vent, such as a "bubble generator," for allowing the ingress of air into the reservoir. A hydrophobic membrane that blocks the flow of ink and allows the flow of air is positioned in the vent to prevent ink from flowing out of the reservoir through the vent.

Other objects and aspects of the invention will become apparent to those skilled in the art from the detailed description of the invention which is presented by way of example and not as a limitation of the present invention.

DESCRIPTION OF THE ILLUSTRATED EMBODIMENT

Figure 1:
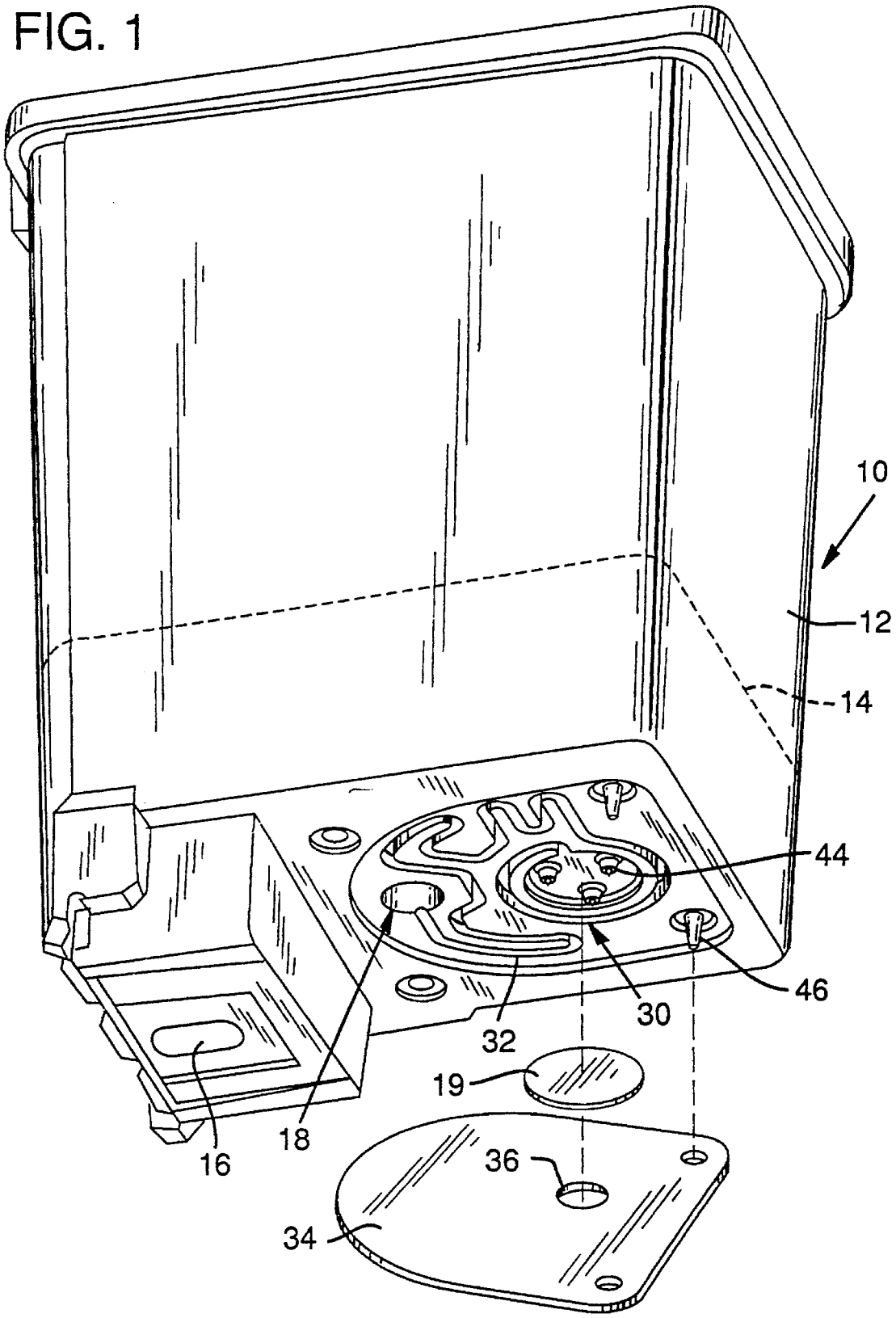
FIG. 1 is a partially exploded, bottom, perspective view of an ink pen in accordance with one embodiment of the present invention.

An ink pen in accordance with a preferred embodiment of the present invention is illustrated in FIG. 1 as reference numeral 10. The ink pen 10 has a reservoir 12 for storing a supply of ink 14. The reservoir is in fluid communication with a print head 16 which ejects ink drops onto a printing surface to form characters and images. The ink within the reservoir is subject to an initial backpressure to prevent the ink from drooling through the print head.

The initial backpressure is created and maintained with the aid of a biased expandable bladder (not shown) positioned within the ink reservoir. Any one of a number of known expandable bladder structures may be used, so long as the expandable bladder can respond to environmental changes, depletion of ink from the reservoir, or the like, to help regulate the backpressure within the reservoir. The reservoir 12 is provided with a bubble generator 18 which allows air to enter the reservoir in a controlled manner to regulate the backpressure within the reservoir. A hydrophobic membrane 19 is positioned in the path of the bubble generator. The hydrophobic membrane 19 allows the passage of air and blocks the passage of ink. In this manner, the hydrophobic membrane prevents ink leakage from the ink pen through the bubble generator while allowing the free flow of air necessary for the proper operation of the bubble generator.

Figure 3:
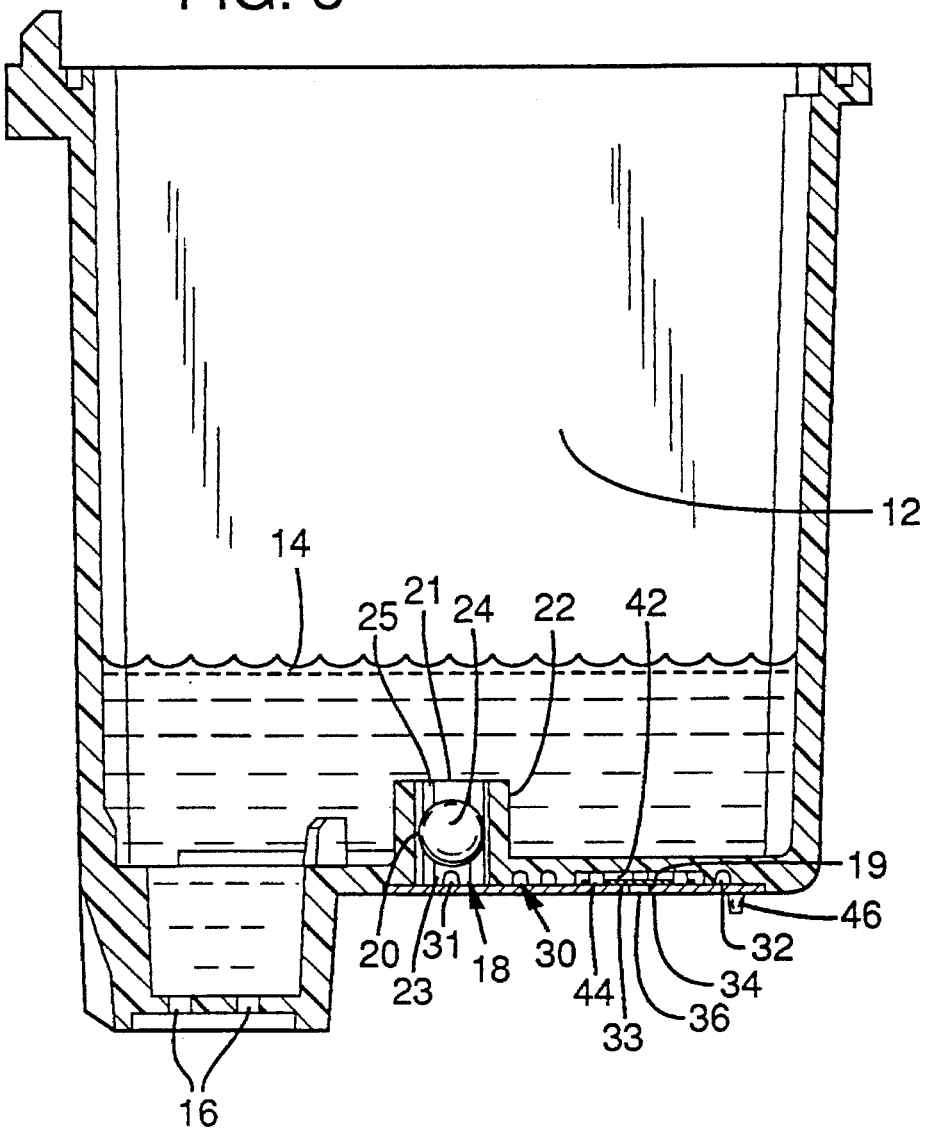
FIG. 3 is a cross sectional view taken along line 3—3 in FIG. 2.

As shown best in FIG. 3, the illustrated bubble generator 18 consists of a tubular boss 22 formed in the bottom wall of the reservoir. One end 21 of the boss 22 extends into the reservoir where it is open to allow ink to enter the boss. The other end 23 of the boss 22 opens to an inlet labyrinth 30 through which air can enter the boss. A sphere 24 is mounted concentrically within the boss 22 to divide the first end 21 from the second end 23. The outside diameter of the sphere 24 is smaller than the inside diameter of the boss 22 such that the sphere and boss define an annular orifice 20. A plurality of raised ribs 25 on the inside of the cylindrical boss 22 engage the sphere 24 to maintain it in position within the boss.

Normally, a quantity of ink is trapped within the annular orifice 20 to prevent the ingress of air through the bubble generator. The ink trapped within the orifice 20 is supplied from the reservoir. In its normal orientation the boss 22 is submerged in the ink until the reservoir is nearly depleted. This allows a quantity of ink from the reservoir to enter the boss to seal the orifice. In other orientations, or when the ink reservoir is nearly depleted, the sphere 24 serves as a capillary member to maintain a quantity of ink within the boss 22. As a result, even when the pen is oriented such that the boss is not submerged in the reservoir ink, a quantity of ink is trapped within the boss 22 to seal the orifice 20.

Due to the curved surface of the sphere 24, the gap between the exterior surface of the sphere and the inner wall of the boss is smallest at the orifice 20 and increases as the distance from the orifice increases. This geometry, coupled with the capillarity of the ink, constantly urges the trapped quantity of ink toward the orifice—the smallest portion of the gap—to provide a robust seal.

However, if the backpressure within the pen exceeds a particular level, the capillary forces holding the ink within the annular gap are overcome by the pressure gradient across the bubble generator and air is allowed to bubble through the trapped ink to thereby lower the backpressure. The particular backpressure level at which any given bubble generator will admit air is a function of the material which the boss and sphere are made of, the size and geometry of the annular orifice, the viscosity and surface tension of the ink, and other similar factors. These factors are typically selected such that the bubble generator prevents the backpressure within the reservoir from exceeding the operating range of the ink pen.

Figure 2:
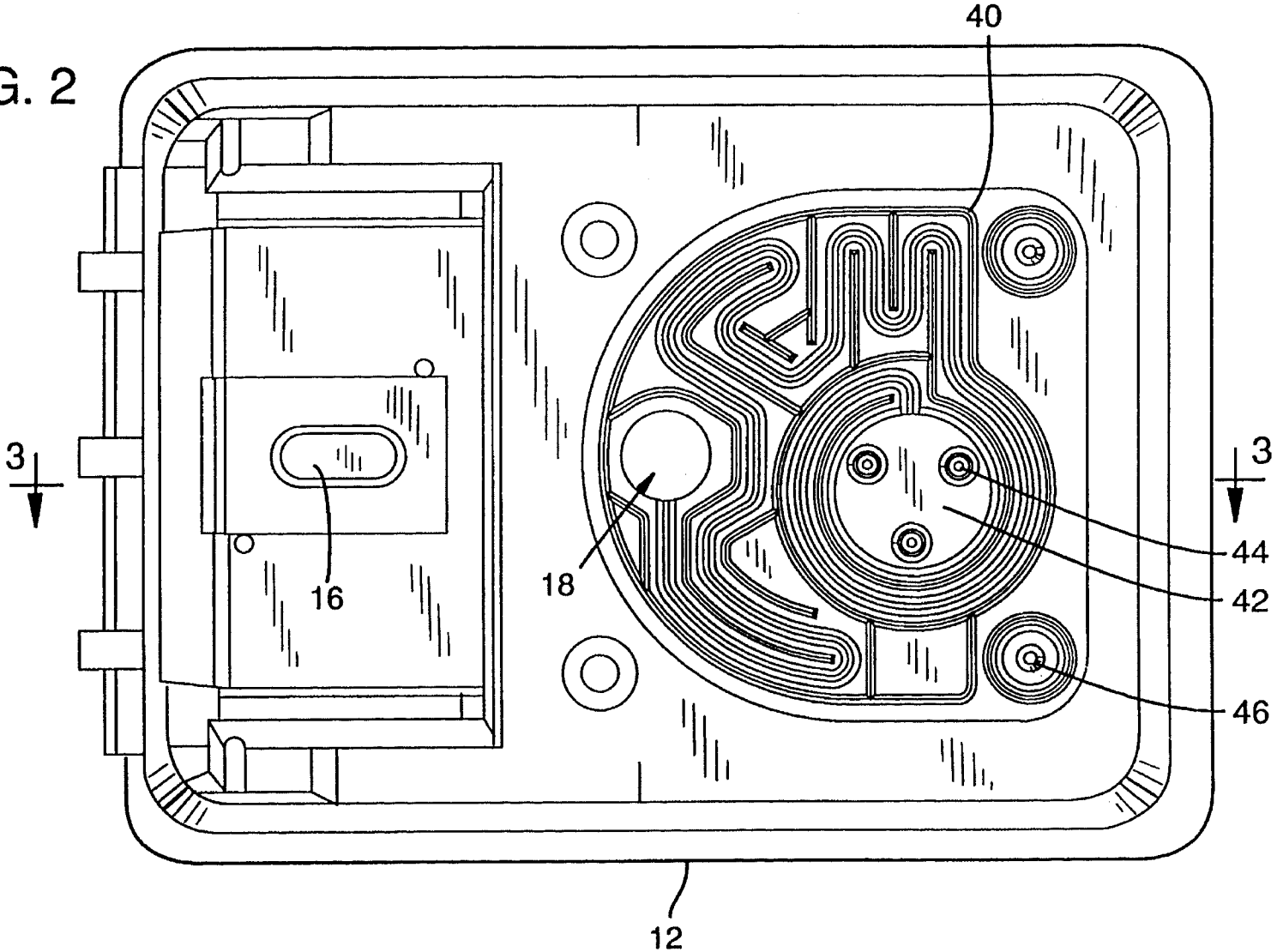
FIG. 2 is bottom view of the ink pen of FIG. 1.

To prevent the trapped quantity of ink from drying or solidifying as a result of prolonged exposure to the atmosphere, the bubble generator is provided with an inlet labyrinth 30 which serves as a vapor barrier. The inlet labyrinth 30, best seen in FIGS. 1 and 2, is a path through which the ambient air must travel before contacting the trapped ink. The proximal end 31 of the labyrinth opens to the boss and the distal end 33 is covered with the hydrophobic membrane 19 and open to the ambient air through hole 36. The length of the labyrinth is sealed from both the ambient and the reservoir. As a result, the humidity within the labyrinth varies along its length from approximately 100% at the proximal end 31 to approximately ambient at the distal end 33. This humidity gradient serves to shield the trapped ink from direct contact with ambient air and prevent the trapped ink from drying or solidifying.

The inlet labyrinth 30 also serves as an overflow receptacle. If the ink pen is subject to an extreme environmental change, or if the expandable bladder fails causing the backpressure within the reservoir to drop below the level necessary to prevent ink from leaking through the annular orifice 20, the ink can exit the reservoir via the bubble generator and enter the inlet labyrinth 30. The hydrophobic membrane 19 prevents the ink from leaking from inlet labyrinth through hole 36. Subsequently, when conditions return to normal, the ink in the inlet labyrinth can reenter the reservoir.

The hydrophobic membrane 19 is made of a material which allows air to pass but which blocks the flow of ink. In this manner, the hydrophobic membrane 19 prevents any ink which enters the inlet labyrinth 30 through the bubble generator 18 from leaking from the ink pen. At the same time, the hydrophobic membrane 19 allows the flow of air through the hole 36 to the bubble generator 18 to ensure its proper operation.

In the illustrated embodiment, a material sold under the designation PALL FLEX JO1426W has been found to be a satisfactory hydrophobic membrane. However, other materials may also work. An appropriate material should allow an adequate flow of air to ensure proper operation of the bubble generator. At the same time, the hydrophobic material must block the flow of ink to prevent ink from leaking from the pen through the bubble generator. In the illustrated embodiment, the material preferably allows the flow of air through the hole 36 at a rate of about 5.5 cubic centimeters per minute per square millimeter with a pressure drop of less than about 1.3 centimeters water column. The material in the illustrated embodiment also preferably blocks the flow of ink up to a pressure of at least about 51 centimeters water column.

In addition, the material preferably allows ink to be easily removed from its surface. This characteristic helps to allow ink within the labyrinth to return via the bubble generator to the reservoir when the proper backpressure is restored. In the illustrated embodiment, it is preferable that ink can be removed from the membrane with a pressure of less that about 20.4 centimeters water column. It is also preferable that the material resist the absorption and saturation of ink. Otherwise, when the backpressure is restored, the material may not allow the free flow of air necessary for the bubble generator to function properly.

As seen in FIGS. 1, 2, and 3, the inlet labyrinth in the illustrated embodiment, is a trough 32 molded directly into the external surface of the reservoir 12. The exact dimensions of the trough are chosen to ensure an adequate humidity gradient to prevent the liquid seal of the bubble generator from drying out. In the illustrated embodiment, the trough is about 0.64 millimeters deep and about 0.64 millimeters across. A cover 34 is attached to the external surface of the reservoir over the trough 32 to seal the length of the trough. A hole 36 corresponding with the distal end of the trough 32 is provided in the cover 34 to allow air to enter the trough. The hydrophobic membrane 19 is attached to the inside of the cover 34 over the hole 36.

To receive the hydrophobic membrane, the distal end of the trough is provided with a well 42. In order to ensure a good seal around the well when the cover is attached, it is preferable that the well be larger than the diameter of the hydrophobic material so that the hydrophobic material does not contact the edges of the trough. Three support columns 44 are formed in the well 42 to support the span of the cover 34 and the hydrophobic membrane over the well.

In the illustrated embodiment, the hydrophobic membrane is attached to the underside of the cover by heat staking. That is, the hydrophobic membrane is placed in position adjacent the cover and a heated element is brought into contact with the hydrophobic material. This causes the cover, which is preferably made of polysulfone, to melt and fuse to the hydrophobic membrane. Preferably, the bond between the hydrophobic material and the cover is formed at the periphery of the hydrophobic membrane. This maximizes the area of the hydrophobic membrane through which air is allowed to pass.

In a preferred method of attaching the hydrophobic membrane to the cover, the heated element is provided with a raised burr corresponding to the desired outline of the hydrophobic membrane. A strip of hydrophobic material is placed over a cover and the heated element is brought into contact. As pressure is applied, the burr of the heated element simultaneously cuts the hydrophobic material to form the hydrophobic membrane and heat stakes the periphery of the hydrophobic membrane to the cover.

Figure 4:
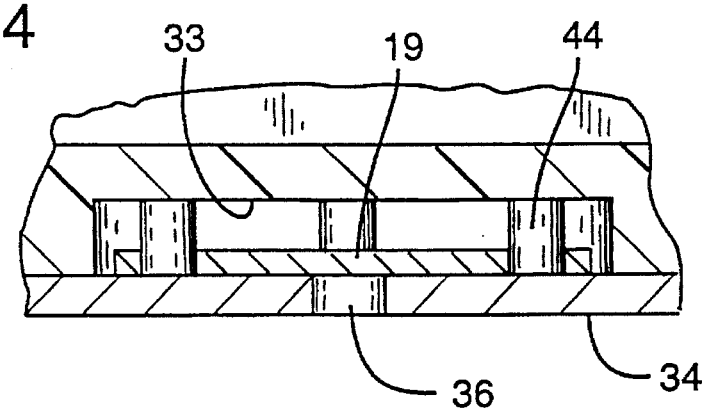
FIG. 4 is an enlarged view of a portion of FIG. 3 showing the hydrophobic vent.

In the illustrated embodiment, the cover is attached to the reservoir body by ultrasonic welding. A raised ridge 40 surrounding the trough (seen only in FIG. 2) serves as an energy director to facilitate the welding process and seal the trough. The cover is positioned over the trough by means of alignment pins 46. Once in place, the ultrasonic welding horn is brought in contact with the cover. The welding apparatus then causes the cover to vibrate at ultrasonic frequencies (typically 20 kHz or 40 kHz) while simultaneously applying pressure to the cover. The high frequency vibrations generate enough friction to cause the raised ridge 40 and the portion of the cover in contact with the raised ridge to melt. The pressure applied causes the ridge to flatten and fuse to the cover thereby "welding" the parts together. As illustrated in FIGS. 3 and 4, the support columns may melt through the membrane and fuse directly to the cover during the ultrasonic welding process.

This detailed description is set forth only for purposes of illustrating examples of the present invention and should not be considered to limit the scope thereof in any way. Clearly, numerous additions, substitutions, and other modifications can be made to the invention without departing from the scope of the invention which is defined in the appended claims and equivalents thereof.

We claim:

1. A pen for an ink-jet printer comprising:

a reservoir for holding a supply of ink;

a vent in the reservoir for selectively admitting ambient air into the reservoir to maintain a backpressure within the reservoir within an operating range for the ink pen which allows the ink pen to eject said ink while preventing free flow of said ink from the ink pen, the vent comprising a bubble generator that traps a quantity of said ink within the vent by capillary forces, said trapped quantity of ink sealing the vent when the backpressure is within said operating range and allowing said ambient air to bubble through said trapped quantity of ink and into the reservoir when said backpressure exceeds said operating range to thereby lower the backpressure;

a hydrophobic membrane; and a path connecting said bubble generator and said hydrophobic membrane.

2. An ink pen in accordance with claim 1 wherein said path consist of an inlet labyrinth positioned between said bubble generator and said hydrophobic membrane, said inlet labyrinth providing a containment volume for ink exiting the reservoir through the vent when the backpressure within the reservoir falls below said operating range.

3. An ink pen in accordance with claim 2 in which the bubble generator comprises a capillary member positioned within said vent to trap said trapped quantity of ink within the vent to seal the vent when the backpressure within the reservoir is within said operating range.

4. An ink pen in accordance with claim 3 in which the vent comprises a tubular boss having the capillary member disposed therein.

5. An ink pen in accordance with claim 4 in which the capillary member is a sphere concentrically fixed within the boss.

6. An ink pen in accordance with claim 1 in which the hydrophobic membrane allows passage of said air at a rate of about 5.5 cubic centimeters per minute per square millimeter with a pressure drop of less than about 1.3 centimeters water column.

7. An ink pen in accordance with claim 1 in which the hydrophobic membrane prohibits flow of said ink through said membrane up to a pressure of about 51 centimeters water column.

8. An ink pen in accordance with claim 1 in which said ink is removed from a surface of the hydrophobic member when subject to a pressure of less than about 20.4 centimeters water column.

9. A system for maintaining backpressure within an ink pen for an ink-jet printer, the ink pen having a reservoir for containing a supply of ink, an expandable bladder within the reservoir and a spring biasing said expandable bladder to create a backpressure with the reservoir, the system for maintaining the backpressure within the reservoir within an operating range comprising:

a bubble generator for admitting ambient air into the reservoir when the backpressure exceeds said operating range, said bubble generator having a cylindrical boss with a spherical member disposed concentrically therein to define an orifice, said orifice maintaining a quantity of said ink within the orifice to seal the orifice when the backpressure is within said operating range and allowing said air to bubble through said quantity of ink when the back pressure exceeds said operating range to thereby lower the backpressure;

an inlet labyrinth having a first end in fluid communication with said boss and a second end, said inlet labyrinth providing a containment volume for ink that flows through the bubble generator when the backpressure in said reservoir falls below said operating range; and a hydrophobic membrane covering said second end, said hydrophobic membrane allowing passage of said air through said second end and into said inlet labyrinth and blocking passage of said ink through said second end to prevent ink from escaping from said inlet labyrinth through said second end.

10. A method of maintaining backpressure within an ink pen for an ink-jet printer to within an operating range which allows the ink pen to eject said ink while preventing free flow of said ink from the ink pen, ink pen having a reservoir for containing a supply of ink at a backpressure, the method comprising the steps of:

providing a vent in the reservoir, the vent having a first end in communication with said reservoir and a second end in communication with ambient air;

positioning a capillary member within the vent to form a bubble generator;

providing a hydrophobic membrane;

providing a path connecting said bubble generator and said hydrophobic membrane;

trapping a quantity of ink within the bubble generator by capillary forces of said ink, said trapped quantity of ink sealing the vent when the backpressure within the reservoir is within the operating range; and allowing said ambient air to bubble through said trapped ink and into the reservoir when the backpressure exceeds said operating range to thereby lower the backpressure within said reservoir.

11. A method of maintaining backpressure within an ink pen for an ink-jet printer to within an operating range which allows the ink pen to eject said ink while preventing free flow of said ink from the ink pen, the ink pen having a reservoir for containing a supply of ink at a backpressure, the method comprising the steps of:

providing a vent in the reservoir, the vent having a first end in communication with said reservoir and a second end in communication with ambient air;

trapping a quantity of ink within the vent by capillary forces of said ink, said trapped quantity of ink sealing the vent when the backpressure within the reservoir is within the operating range;

allowing said ambient air to bubble through said trapped ink and into the reservoir when the backpressure exceeds said operating range to thereby lower the backpressure within said reservoir;

providing an inlet labyrinth having a first end in communication with the second end of the vent and a second end in communication with said ambient air, said inlet labyrinth receiving ink exiting the reservoir through the vent; and providing a hydrophobic barrier over the second end of the inlet labyrinth.

12. The method of claim 11 wherein the step of providing a vent comprises the steps of:

providing a tubular boss having a generally cylindrical inner wall; and fixing a capillary member within said boss to form an orifice between the capillary member and the inner wall within which the trapped quantity of ink is trapped.

13. The method of claim 11 wherein the step of providing a vent comprises the steps of:

providing a tubular boss having a generally cylindrical inner wall; and fixing a generally spherical capillary member within said boss to form an orifice between the capillary member and the inner wall within which the trapped quantity of ink is trapped.

* * * * *